US005130291A

United States Patent [19]

Okuda

[11] Patent Number: 5,130,291

[45] Date of Patent: Jul. 14, 1992

[54] HEAT-SENSITIVE RECORDING PAPER

[75] Inventor: Katsumi Okuda, Osaka, Japan

[73] Assignee: Osaka Sealing Printing Co., Ltd., Osaka, Japan

[21] Appl. No.: 633,155

[22] Filed: Dec. 21, 1990

Related U.S. Application Data

[63] Continuation-in-part of Ser. No. 471,907, Jan. 29, 1990, abandoned.

[30] Foreign Application Priority Data

Feb. 6, 1989 [JP] Japan ..... 1-27784
Feb. 6, 1989 [JP] Japan ..... 1-27785

[51] Int. Cl.[5] ..... B41M 5/30; B41M 5/36

[52] U.S. Cl. ..... 503/207; 427/152; 503/216; 503/226

[58] Field of Search ..... 503/200, 207, 226, 214, 503/216; 427/152

[56] References Cited

FOREIGN PATENT DOCUMENTS 2181563 4/1987 United Kingdom ..... 503/207

*Primary Examiner*—Pamela R. Schwartz
*Attorney, Agent, or Firm*—Jordan and Hamburg

[57] ABSTRACT

A heat-sensitive recording paper includes a sheet substrate, a heat-sensitive developing layer formed on the surface of the sheet substrate which develops when heated, and a covering layer formed on the heat-sensitive developing layer. The covering layer includes a pigment prepared by coating the surface of natural mica with at least one of titanium oxide and iron oxide.

The developing part of the heat-sensitive developing layer appears in a color different from that of the heat-sensitive developing layer due to a regular multiple reflection which takes place in the covering layer. Moreover, a non-developed part of the heat-sensitive developing layer has a pearl luster resulting from the regular multiple occurring in the covering layer.

10 Claims, 1 Drawing Sheet

HEAT-SENSITIVE RECORDING PAPER

This application is a continuation-in-part of application Ser. No. 07/471,907, filed Jan. 29, 1990 is now abandoned.

BACKGROUND OF THE INVENTION

1. Field of the Invention

The present invention relates to a heat-sensitive paper.

2. Description of the Prior Art

In conventional heat-sensitive papers, a heat-sensitive developing layer which develops on heating is formed on the surface thereof. Hence, with this kind of heat sensitive paper, a given part can be developed by heating the heat-sensitive developing layer on the given part. Such heat-sensitive recording papers are widely used as recording papers for facsimiles, computers, recorders, card issuing machines and the like.

As the sheet substrate for a conventional heat-sensitive recording paper, white paper or the like has been used and characters, patterns and the like are developed in black, red, blue, et cetera, when the heat-sensitive developing layer is heated.

SUMMARY OF THE INVENTION

It is a primary object of this invention to provide a heat-sensitive recording paper which develops in a color hitherto unattainable.

The present invention relates to a heat-sensitive recording paper comprising a sheet substrate, a heat-sensitive developing layer which develops on heating and also a covering layer formed on the heat-sensitive developing layer the covering layer including a pigment prepared by coating the surface of natural mica with at least one of titanium oxide and iron oxide.

A ray of light incident upon the covering layer is regularly multiple-reflected by the pigment prepared by coating natural mica with titanium oxide, iron oxide and the like.

According to this invention, the developing part of the heat-sensitive developing layer appears in a color different from that of the heat-sensitive developing layer due to the regular multiple reflection which takes place in the covering layer. Moreover, the non-developed part of the heat-sensitive developing layer has a pearl lustre also due to the regular multiple reflection in the covering layer.

The aforementioned objects, other objects, features and advantages of this invention will become more apparent from reading of the detailed description of the example given below with reference to the accompanying drawing.

BRIEF DESCRIPTION OF THE DRAWINGS

FIG. 3 is a schematic flow diagram of a process for coating the surface of natural mica with titanium oxide or iron oxide.

DESCRIPTION OF THE PREFERRED EMBODIMENTS

Figure 1:
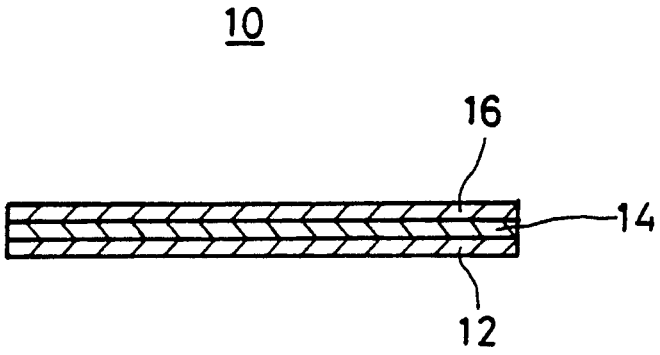
FIG. 1 is a sectional view illustrating a first embodiment of the present invention.

In the embodiment illustrated in FIG. 1, a heat-sensitive paper 10 includes a sheet substrate 12, which is formed of a sheet material such as paper, or synthetic resin.

On one principal surface of the sheet substrate 12 there is formed a heat-sensitive developing layer 14 which is developed on heating.

This heat-sensitive developing layer 14 is formed by coating the surface of the sheet substrate 12 with a mixture of a color-former, color developer and binder.

The color former may be selected from the triarylmethane type dyes such as 3,3-bis(p-dimethylaminophenyl)-6-dimethylaminophthalide, 3,3-bis(p-dimethylaminopheny)phthalide, 3-bis(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethyl-indole-3-yl)-6-dimethylaminophthalide, 3,3-bis(9-ethylcarbazole-3-yl)-6-dimethylaminophthalide, 3,3-bis(2-phenyl-indole-3-yl)-6-dimethylaminophthalide and 3-p-dimethylaminophenyl-3-(1-methylpyrrol-3-yl)-6-dimethylaminophthalide, diphenyl-methane-type dyes such as 4,4'-bis-dimethylaminobenz-hydrilebenzyl ether, N-halophenyl-leucoauramine and N-2,4,5-trichlorophenyl-leucoauramine, thiazine-type dyes such as benzoyl-leucomethylene blue and p-nitrobenzoyl-leucomethylene blue, spyro-type dyes such as 3-methyl-spyro-dinaphthobiran, 3-ethyl-spyro-dinaphthobiran, 3-pyenyl-spyro-dinaphthobiran, 3-benzyl-spyro-dinaphthobiran, 3-methyl-naphtho(6'-methoxy-benzo)spyrobiran and 3-propylspyro-dibenzobiran, lactam-type dyes such as rhodamine-beta-anilinolactum, rhodamine(p-nitroanilino)lactam and rhodamine(o-chloroanilino)lactum, and fluoran-type dyes such as 3-dimethylamino-7-methoxyfluran, 3-diethylamino-6-methoxyfluoran, 3-diethylamino-7-methoxy-fluoran, 3-diethylamino-7-chlorofluoran, 3-ethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxyphenylamino)fluoran, 3-(N-ethyl-N-iso-amylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamlino-7-(o-chlorophenylamino)fluoran and 3-pyrrolidino-6-methyl-7-p-butylphenylaminofluoran.

The color developer may be selected, for example, from inorganic acid substances such as active china clay, acid clay, attapulgite, bentonite, colloidal silica and aluminum silica and organic acid substances including phenolic compounds such as 4-tert-butylphenol, 4-hydroxydiphenoxide, alpha-naphthol, beta-naphthol, 4-hydroxyacetophenol, 4-tert-octylcatechol, 2,2'-dihydroxydiphenol, 2,2'methylene-bis(4-methyl-6-tert-isobutylphenol), 4,4'-isopropylidene-bis(2-tertyt-butylphenol), 4,4'-sec-butylidenediphenol, 4-phenylphenol, 4,4'-isopropylidenediphenol (bisphenol A), 2,2'-methylene-bis(4-chlorophenol), hydroquinone, 4,4'-cyclohexylidene-diphenol, 4-hydroxy-benzyl benzoate, 4-hydroxy-dimethylphthalate, hydroquinone-monobenzyl ether, novolak-type phenolic resins and phenol copolymers, aromatic carboxylic acids such as benzoic acid, p-tert-butyl benzoic acid, trichlorobenzoic acid, telephthalic acid, 3-sec-butyl-4-hydrocybenzoic acid, 3-cyclohexyl-4-hydroxybenzoic acid, 3,5-dimethyl-4-hydroxybenzoic acid, salicylic acid, 3-isopropylsalicylic acid, 3-tert-butyl salicylate, 3-benzyl salicylate, 3-(alpha-methylbenzyl)salicylic acid, 3-chlor-5-(alpha-methylbenzyl)salicylic acid, 3,5-di-tert-butylsalicylate, 3-phenyl-5-(alpha, alpha-dimethylbenzyl)salicylic acid and 3,5-di-alpha-methylbenzylsalicylate and phenolic compounds thereof, and multivalent metallic salts of aromatic carboxylic acids, using, for instance, zinc, magnesium, aluminum, calcium, titanium, manganese, tin and nickel.

The binder may be selected, for example, from polyvinyl alcohol, methylcellulose, methoxyethylcellulose, hydroxyethylcellulose, carboxymethylcellulose, denatured starch, polyvinyl pyrrolidone, acrylic ester and polyacrylamide.

Hence, this heat-sensitive developing layer 14 can be developed by heating.

In order to do arbitrary coloring of the heat-sensitive layer 14, an inorganic filler or organic filler may be added as necessary to the mixture forming the heat-sensitive developing layer 14 as well as a sensitizer or the like so as to raise the sensitivity to heat of the heat-sensitive developing layer 14.

As inorganic filler pigment may be cited, among others, aluminum hydroxide, heavy calcium carbonate, light calcium carbonate, titanium oxide, barium sulfate, silica gel, activated clay, talc, clay, kaolinite, diatomaceous earth, magnesium carbonate, alumina and aluminum oxide, while as organic filler pigment may be cited, among others, polystyrene resin particles, urea-formaldehyde resin and polyolefin particles.

As sensitizer may be cited, among others, amides such as amide stearate, amide palmitinate, amide oleate, amide laurinate, ethylene-bis-stearamide, methylene-bis-stearamide and methylolstearamide, paraffin waxes and higher alcohols.

To the mixture constituting the heat-sensitive layer 14 may further be added a hardener for hardening the binder in the mixture and a lubricant for preventing adhesion of the heat-sensitive developing layer 14 in the printer to thereby improve its travelling property.

Material for the heat-sensitive developing layer 14 may be comprised a mixture of aromatic isocyanate and imino compound. As aromatic isocyanatre may be cited, among others, 2,5-dimethoxy-4,4',4''-triisocyanate-triphenylaine. This isocyanate may, as necessary, be used as an addition compound with phenols, lactams, oxime or the so-called blocked isocyanates.

As amino compound may be cited, among others, 3-iminoisoindoline-1-on, 3-imino-4,5,6,7-tetrachloroisoindoline-1-on, 3-imino-4,5,6,7-tetrapromoisoindoline-1-on, 3-imino-4,5,6,7-tetrafluoroisoindoline-1-on, 3-imino-5,6-dichloroisoindoline-1-on, 1,3-diiminoisoindoline, 1,3-diimino-4,5,6,7-tetrachloroisoindoline, 1,3-diimino-4,5,6,7-tetrafluoroisoindoline and 1,3-diimino-5,6-dichloroisoindoline.

Material for the heat-sensitive developing layer 14 may as well comprised a mixture of a methine-type pigment and an oxidizing organic compound. As methine-type pigment may be selected from among others, the following compounds;

(A) Triaminotriphenylmethan-type pigments such as 4,4',4''-tris-dimethylaminotriphenylmethane, 4,4',4''-tris-diethylamino-triphenylmethane, 4,4'-bis-methylamino-4''-dimethylamino-triphenylmethane, 4,4'-bis-dimethylamino-4-methylamino-triphenylmethane, 4,4-bis-diethylamino-4''-ethylamino-triphenylmethane, 4,4'-bis-diethylamino-4''-aminotriphenylmethane, 4,4'-bis-dimethylamino-3''-methyl-4''-aminotriphenylmethane, 4,4'bis-dimethylamino-3''-methyl-4''-methylamino-triphenylmethane, 4,4',4''-tris-phenylaminotriphenylmethane, 4,4',4''-tris(N-methyl-N-phenylamino)-triphenylmethane, 4,4'-bis-morpholino-4''-dimethylaminotriphenylmethane, 4,4',4''-tris-dimethylamino 2,2'-dimethyl-triphenylmethane, 4,4',4''-tris-dimethyl-amino-3,3'-dimethyl-triphenylmethane, 4,4',4''-tris-dimethylamino-2-methoxy-tripohenylmethane, 4,4',4''-tris-dimethylamino-3-methyl-triphenylmethane, 4,4'-bis-dimethylamino-4''-N-benzylamino-triphenylmethane, 4,4'-bis-dimethylamino-4''-N-benzylamino-3''-methoxytriphenylmethane, 4,4'-bis-dimethylamino-4''-N-benzylamino-3''-methyl-triphenylmethane, 4,4'-bis-dimethylamino-3''-chlor-4''-N-benzylaminotriphenylmethane, 4,4'-bis-dimethylamino-4''-(N-benzyl-N-methylamino)-triphenylmethane, 4,4'-bis-dimethylamino-4''-(N-o-chlorobenzyl-N-methylamino)-triphenylmethane, 4,4'-bis-dimethylamino-4''-(N-p-chlorobenzyl-N-methylamino)-triphenylmethane, 4,4'-bis-dimethylamino-4''-(N-p-methylbenzyl-N-methyl)-triphenylmethane, 4,4'-bis-dimethylamino-4''-(N,N-dibenzylamino)-triphenylmethane, 4,4'-bis-dimethylamino-4''-(N-phenyl-N-methylamino)-triphenylmethane, 4,4'-bis-dimethylamino-4''-morpholino-triphenylmethane, 4,4'-bis-N-benzylamino-4''-dimethylamino-triphenylmethane, 4,4'-bis-(N-benzyl-N-methylamino)-4''-dimethylaminotriphenylmethane, 4,4-bis(parachlorobenzyl-N-methylamino)-4''-dimethylaminotriphenylmethane, 4,4-bis(N-parabrombenzyl-N-ethylamino)-4''-diethylamino-triphenylmethane, 4,4'-bis-pyrrolidyl-4''-dimethylaminotriphenylmethane, 4,4'-bis-(N-orthochlorobenzyl-N-methylamino)-4''-dimethylamino-triphenylmethane, 4,4'-bis-pyrrolidyl-4''-(N-benzyl-N-methylamino)triphenylmethane, 3,3'-dichloro-4,4'-bis(N-benzylamino)-4''-dimethylaminotriphenylmethane, 4,4'-bis(N-p-methylbenzyl-N-methylamino)-4''-dimethylamino-triphenylmethane, 4,4'-bis(N-p-methylbenzyl-N-ethylamino)-4''-diisopropylamino-triphenylmethane, 3,3-dimethyl-4,4'-bis(p-methylbenzylamino)-4''-dimethylaminotriphenylmethane, 3,3-demithyl-4,4'-bis(N-benzylamino)-4''-dimethylamino-triphenylmethane and 3,3-dibutyl-4,4'-bis-N-benzylamino-4''-diethylaminotriphenylmethane, et cetera;

(B) Diaminotriphenylmethane-type pigments such as 4,4'-bis-dimethylamino-triphenylmethane, 4,4'-bis-dimethylamino-4''-methyl-triphenylmethane, 4,4'-bis(N-benzyl-N-ethylamino)triphenylmethane, 4,4'-bis-dimethylamino-2-chlortriphenylmethan, 4,4'-bis-diisopropylamino-3''-bromotriphenylmethane, 4,4'-bis-dimethylamino-4''-methoxytriphenylmethane, 4,4'-bis-dimethylamino-4''-ethoxytriphenylmethane, 4,4'-bis-dimethylamino-3''-methyl-4''-methoxytriphenylmethane, 4,4'-bis-dimethylamino-3''-methyl-4''-ethoxytriphenylmethane, 4,4'-bis-dimethylamino-3'',4''-dimethoxytriphenylmethane, 4,4'-bis-dimethylamino-2'',4''-dimethoxytriphenylmethane, 4,4'-bis-diethylamino-3''-ethyl-4''-ethoxy-triphenylmethane, 4,4'-bis-methylamino-3,3'-dimethyl-3''-butyl-4''-butoxy-triphenylmethane, 4,4'-bis-dimethylamino-3''-cyclohexyl- 4''-methoxy-triphenylmethane, 4,4'-bis-propylamino-3''-phenyl-4''-propoxy-triphenylmethane, 4,4'-bis(N-benzyl-N-methylamino)-3''-propyl-4''-methoxytriphenylmethane, 4,4'-bis(N-benzyl-N-methyl-amino)-3''methyl-4''-ethoxytriphenylmethane, 4,4'-bis-N-pyrrolidyl-3''-methyl-4''-methoxy-triphenylmethane, 4,4-bis-N-piperidyl-3''-methyl-4''-ethoxy-triphenylmethane and 4,4'-dimethylamino-3''-tert-butyl-4''-methoxy-triphenylmethane;

(C) Monoaminotriphenylmethane-type pigments such as 4,4'-dimethoxy-4''-dimethylaminotriphenylmethane, 4,4'-dimethoxy-3''-methyl-4''-methylaminotriphenylmethane, 4,4''-diethoxy-4''-diethylaminotriphenylmethane, 4,4''-dimethoxy-4''-(N-benzyl-N-methylamino)-triphenylmethane, 3,3'-dimethyl-4,4'-dimethoxy-4-dimethylaminotriphenylmethane, 4,4'-dimethoxy-4''-pyrrolidinotriphenyl-methane, 4,4'-dimethyl-4''-diethylaminotriphenylmethane and 4-methoxy-4'-diethylamino-triphenylmethane;

(D) Naphtyl-methane-type pigments such as bis(4-dimethylamino-naphthyl-1-4'-dimethylaminophenylmethane, bis(4-ethylamino-naphthyl-1)-4'-dimethylamino-phenylmethane, bis(4-N-paratolyl-N-methyl-aminonaphthyl-1)-4'-isopropylaminophenylmethane, tris(4-dimethylamino-naphthyl-1)methane, bis(4-dimethylaminonaphthyl-1)-4'-N-morpholinophenylmethane, bis(4-diethyllamiknophenyl)-4'-N-phenylaminonaphthyl-1'-methane, bis(4-diethylaminophenyl)-4'-ethylaminonaphthyl-1'-methane, bis(4N-phenyl-N-methylaminonaphthyl-1)-beta-styrylmethane, bis(4-dimethylamino-naphthyl-1)-p-chloro-styrylmethane, bis(4-dimethylaminophenyl)-2'-methoxynaphthyl-1'-methane, bis(4-dimethylaminophenyl)-4'-methoxy-naphthyl-1'-methane, bis(4-dimethylaminophenyl)-naphthyl-2'-methane, bis(4-N-propylaminophenyl)-4'-proposynaphthyl-2-methane, bis(4-dimethylaminonaphthyl-1)-2'-pyridylmethane, bis(4-dimethylaminonaphthyl-1)-2'-pyrazylmethane and bis(4-dibenzylaminonaphthyl-1)-quinoline-3'-yl-methane;

(E) Diphenyl-beta-styrylmethane-type pigments such as bis(4-dimethylaminophenyl)-beta-styrylmethane, bis(3-methyl-4-N-phenyl)-beta-styrylmethane, bis(4-N-benzyl-N-methylaminophenyl)-beta-styrylmethane, bis(4-dimethylaminophenyl)-beta-(4'-dimethylaminostyryl)methane, bis(4-dimethylaminophenyl)-beta-(4'-methoxystyryl)methane, bis(4-diethylaminophenyl)-beta-(3'-methyl-4'-ethoxystyryl)methane, bis(3-methyl-4-ethoxyphenyl)-beta-(4'-diethylaminostyryl)methane and 4-methylphenyl-4'-diethylaminophenyl-beta-(3'-tert-butyl-4'-dimethylaminostyryl)methane;

(F) Indolylmethane-type pigments such as phenyl-bis(1-ethyl-2-methyl-indole-3-yl)methane, 4-methoxyphenyl-bis(1'-ethyl-2'-methylindole-3'-yl)methane, 3-methyl-4-methoxyphenyl-bis(1'-ethyl-2'-methylindole-3'-yl)methane, 3,4-dimethoxyphenyl-bis(1'-ethyl-2'-methylindole-3'-yl)methane, 2,4-dimethoxyphenyl-bis(1'-ethyl-2'-methylindole-3-yl)methane, 3,4-diethoxyphenyl-bis(1'-ethyl-2'-methylindole-3'-yl)methane, 3-butyl-4-methoxyphenyl-bis(1'-butyl-2'-methylindole-3'-yl)methane, 4-ethoxyphenyl-bis(1'-ethyl-2'-phenylindole-3'-yl)methane, 4-ethoxyphenyl-bis(1'-ethyl-2'-methyl-indole-3'-yl)methane, phenyl-bis(1'-n-butyl--2'-methyl-indole-3'-yl)methane, phenyl-bis(1'-methyl-2'-phenylindole-3'-yl)methane, bis(4-dimethyl-amino-phenyl)-(1'-ethyl-2'-methyl-indole-3'-yl)methane, bis(1-ethyl-2-methyl-indole-3-yl)-2'-naphthylmethane, bis(1-ethyl-2-methyl-indole-3-yl)-1'-naphthylmethane, tris(1-ethyl-2-methyl-indole-3-yl)methane, tris(1-n-butyl-2-metylindol-3-yl)methane, bis(1-ethyl-2-methyl-indole-3-yl)-3'-chloro-4'-methoxyphenylmethane, bis(1-propyl-2-phenyl-indole-3-yl)-phenylmethane, bis(1-octyl-2-methyl-indole-3-yl)phenylmethane, bis(1-benzyl-2-methyl-indole-3-yl)phenylmethane, bis(1-ethyl-2-methyl-indole-3-yl)-2'-methyl-indole-3-yl)-3'-methyl-phenylmethane, bis(1-ethyl-2-methyl-indole-3-yl)-4'-methylphenylmethane, bis(1-ethyl-2-methyl-indole-3-yl)-2'-methoxyphenylmethane, bis(1-ethyl-2-methyl-indole-3-yl)-4'-fluorophenylmethane, bis(1-ethyl-2-methyl-indole-3-yl)-4'-bromphenylmethane, bis(1-hexyl-indole-3-yl)-phenylmethane, bis(1--ethyl-2-methyl-indole-3-yl)-3'-nitrophenylmethane, bis(1-ethyl-2-methyl-indole-3-yl)-3',4'-dichloro-phenylmethane, bis(1-ethyl-2-methyl-indole-3-yl)-2'-thienylmethane, bis(1-ethyl-2-methyl-indole-3-yl)-4'-methyl-2'-thienylmethane, and bis(1-butyl-2-methyl-indole-3-yl)-4'-pyridylmethane;

(G) Other leucomethine-type pigments such as 3,6-bis-dimethylamino-9-phenylxanthene, 3,6-bis-diethylamino-9-phenylxanthene, 3,6-bis-dimethylamino-9-(3'-methyl-4'-xanthene dimethylaminophenyl)xanthene, 3-diethylamino-6,7-dimethyl-9-phenylxanthene, 3,6-dimethoxy-9-(4'-dimethylaminophenyl)xanthene, 3,6-di-ethoxy-9-(4'-dimethyl-naphthyl-1')xanthene, 3,6-bis(N-methyl-N-phenylamino)-9-(3',4'-dimethoxy-phenyl)xanthene, 3,6-bis-dimethylamino-9-(4'-methoxy-phenyl)-10-methyl-9,10-dihydroacrydine and 3,6-bis-dimethylamino-9-(4'-dimethylaminophenyl)fluorene.

Pigments used in the present invention are not limited to those mentioned above.

As oxidizing organic compounds, which are used for oxidizing methine-type pigments to produce developed images of the oxidizing methine-type when molten and brought into contact with a methine-type pigment, quinone derivatives for example, may be used. Suitable quinone derivatives include, among others, benzoquinone derivatives such as 2,3-dicyano-5,6-dichloro-1,4-benzoquinone, 2,3,5,6-tetracyano-1,4-benzoquinone, 3,4-dibromo-5,6-dicano-1,2-benzoquinone, 3,4,5,6-tetracyano-1,2-benzoquinone, 2,3,5,6-tetrabomo-1,4-benzoquinone, 2,3,5,6-tetraiodo-1,4-benzoquinone, 2,3,5,6-tetra-methoxycarbonyl-1,4-benzo-quinone, 2,3,5,6-tetraethoxycarbonyl-1,4-benzoquinone, 2,3,5,6-tetra-i-butoxycarbonyl-1,4-benzoquinone, 2,3,5,6-tetra-n-hexyloxycarbonyl-1,4-benzoquinone, 2,3,5,6-tetra-(2'-ethylhexyloxycarbonyl)-1,4-benzoquinone, 2,3,5,6-tetradodecyloxycarbonyl-1,4-benzoquinone, 2,3,5,6-tetraphenoxycarbonyl-1,4-benzoquinone, 2,3,5,6-tetra-p-toluiloxycarbonyl-1,4-benzoquinone, 2,3,5,6-tetrabenzyloxycarbonyl-1,4-benzoquinone, 2,3,5,6-tetranaphthoxycarbonyl-1,4-benzoquinone, 3,4,5,6-tetra-propyloxycarbonyl-1,2-benzoquinone, 3,4,5,6-tetra-n-butoxycarbonyl-1,2-benzoquinone, 2,5-dimethoxycarbonyl-3,6-dichloro-1,4-benzoquinone, 2,5-diethoxycarbonyl-3,6-dibromo-1,4-benzoquinone, 2,5-di-i-butoxycarbonyl-3,6-dibromo-1,4-benzoquinone, 2,5-di-n-octoxycarbonyl-3,6-dibromo-1,4-benzoquinone, 2,5-diphenoxycarbonyl-3,6-diiodo-1,4-benzoquinone, 2,5-dibenzyloxy-3,4-dichloro-1,2-benzoquinone, 3,6-di-n-benzyloxycarbonyl-3,4-bichloro-1,4-benzoquinone, 2,5-benzloxycarbonyl-1,4-benzoquinone, 2,5-dibenzoyl-3,6-dichloro-1,4-benzoquinone, 2,5-dibenzoyl-3,6-dibromo-1,4-benzoquinone, 2,5-dibenzoyl-3-bromo-1,4-benzoquinone, 2,5-diacetyl-3,6-dibromo-1,4-benzoquinone, 2,5-diethoxy-carbonyl-3,6-diphenylsulfonyl-1,4-benzoquinone, 2,5-di-n-butoxycarbonyl-3,6-di-4'-tolysulfonyl-1,4-benzoquinone, 2,5-di-n-hexyloxycarbonyl-3,6-diphenylsulphonyl-1,4-benzoquinone, 2,5-di-i-propyloxycarbonyl-3,6-di-p-tolylsulfonyl-1,4-benzoquinone, 2,5-di-i-butoxycarbonyl-3,6-di-p-cyclohexylphenylsulphonyl-1,4-benzoquinone, 2,5-di-(2'-ethylhexyloxycarbonyl)-3,6-di-4'-diphenylsulfonyl-1,4-benzoquinone, 2,5-di-n-propyloxycarbonyl-3,6-di-4'-chlorophenylsulfonyl-1,4-benzoquinone, 2,5-diethoxycarbonyl-3,6-di-4'-methoxy-pohenylsulfonyl-1,4-benzoquinone, 2,5-di-benzyloxycarbonyl-3,6-di-4'-tolysulfonyl-1,4-benzoquinone, 2,5-di-n-octyloxycarbonyl-3,6-di-ethylsulfonyl-1,4-benzoquinone, 2,5-diethoxycarbonyl-3,6-(2'-naphthylsulfonyl)-1,4-benzoquinone, 2,5-dimethoxycarbonyl-3-toluylsulfonyl-1,4-benzoquinone, 3,6-diethoxycarbonyl-4,5-diphenylsulphonyl-1,2-benzoquinone, 2,3,5,6-tetra-4'-toluylsulfonyl-1,4-benzoquinone, 2,3,5,6-tetra-phenylsulfonyl-1,4-benzoquinone, 2,3,5,6-tetraethylsulfonyl-1,4-benzoquinone, 3,4,5,6-tetra-i-butylsulfonyl-1,2-benzoquinone, 2,3,5,6-tetra-n-octylsulfonyl-1,4-benzoquinone, 2,3,5,6-tetra-benzyloxysulfonyl-1,4-benzoquinone, 2,5-di-n-propyloxycarbonyl-3,6-dibenzoyl-1,4-benzoquinone, 2,5-di-i-butoxycarbonyl-3-benzoyl-1,4-benzoquinone, 2,3-dichloro-1,4-benzoquinone-5,6-dicarboxylic acid-butylimido, 1,4-benzoquinone-2,3,5,6-tetracarboxylic acid-diphenylimido, 1,2-benzoquinone-3,4,5,6-tetracarboxylic acid-di-n-octylimido, 2,5-di-ethoxysulfonyl-1,4-benzoquinone, 2,5-diphenoxysulfonyl-3,6-dichloro-1,4-benzoquinone, 2,5-di-n-butoxycarbonyl-3,6-dibutoxysulfonyl-1,4-benzoquinone, 2,5-di-p-toluylsulfonyl-3,6-dibromo-1,4-benzoquinone and 2,5-di-n-hexylsulfonyl-3,6-dichloro-1,4-benzoquinone; diphenoquinone derivatives such as 3,3',5,5'-tetrachloro-4,4'-diphenoquinone, 3,3',5,5'-tetracyano-4,4'-diphenoquinone, 2,2',3,3',5,5',6,6'-octachloro-4,4'-diphenoquinone, 2,2',3,3'-tetracyano-5,5',6,6'-tetrabrom-4,4'-diphenoquinone, 3,3',5,5'-tetraethoxycarbonyl-4,4'-diphenoquinone, 3,3',5,5'-tetrabenzyloxycarbonyl-2,2',6,6'-tetrabromo-4,4'-diphenoquinone, 3,3',5,5'-tetra-p-toluylsulfonyl-4,4'-diphenylquinone, 3,3',5,5'-tetraethoxysulfonyl-4,4'-diphenoquinone, 3,3'-dibenzyloxysulfonyl-5,5'-dibenzyloxycarbonyl-4,4'-diphenoquinone, 3,3',5,5'-tetra-n-propyloxycarbonyl-2,2',6,6'-tetrachloro-4,4'-stilbenequinone, 2,2',3,3',5,5',6,6'-octachloro-4,4'-stilbenequinone and, 2,3-dichloro-4,4-diphenoquinone; 2',3'-dicarboxylic acid ethylimido or stylbenequinone derivatives; naphthoquinone derivcatives; and anthradiquinone derivatives such as oxidizing quinone derivatives (electro-acceptor) oxidizing organic compounds for use in the present invention are not limited to those mentioned above.

For stabilization of the methine-type pigment, at least one of alcanol amines and sequestering agents may be added. Suitable alcanolamines include, among others, the following:

(1) Alcanolamines having tertiary amine group/s such as tris-N-(2-hydroxyethyl)amine, tris-N-(2-hydroxypropyl)amine, tris-N-(3-hydroxybutyl)amine, tris-N-(hydroxybutyl)amine, N,N-dimethyl-N-(2-hydroxyethyl)amine, N,N-diethyl-N-(2-hydroxyethyl)amine, N,N-dipropyl-N-(2-hydroxyethyl)amine, N,N-dibutyl-N-(2-hydroxyethyl)amine, N-methyl-N-phenyl-N-(2-hydroxyethyl)amine, N,N-diphenyl-N-(2-hydroxyethyl)amine, N,N-dimethyl-N-(2-hydroxypropyl)amine, N,N-diethyl-N-(2-hydroxypropyl)amine, N,N-dipropyl-N-(2-hydroxypropyl)amine, N,N-dibutyl-N-(2-hydroxypropyl)amine, N,N-diphenyl-N-(2-hydroxypropyl)amine, N-methyl-N,N-di(2-hydroxyethyl)amine, N-ethyl-N,N-di(2-hydroxyethyl)amine, N-phenyl-N,N-di(2-hydroxyethyl)amine, N-methyl-N,N-di(2-hydroxypropyl)amine, N-acetyl-N,N-di(2-hydroxyethyl)amine, N-acetyl-N,N-di(2-hydroxypropyl)amine, N-hydroxyethylmorpholine, N-hydroxypropylmorpholine, N-tetradecyl-N,N-di(ω-hydroxyethylene)amine, N-dodecyl-N,N-di(ω-hydroxyethylpolyoxyethylene)amine, N-octadecyl-N,N-di(ω-hydroxyethylpolyoxyethylene)amine, N,N-dodecyl-N-(ω-hydroxyethylpolyoxyethylene)amine, N,N-di-(cis-octa-decenyl)-N-(ω-hydroxyethylpolyoxyethylene)amine, N,N-dioctadecyl-N-(ω-hydroxyethylpolyoxyethylene)amine, aliphatic diamine+alkylene oxide addition compounds, N-ω-hydroxyalkylpolyoxyalkylene displacement products of aliphatic amides, and reaction products of ammonia and alycidol (2-amino-propyleneglycol derivative);

(2) Alcanolamines having secondary amino group/s such as N,N-di(2-hydroxyethyl)amine, N,N-di(2-hydroxy-propyl)amine, N-methyl-N-(2-hydroxyethyl)amine, N-butyl-(2-hydroxyethyl)amine, N-dodecyl-N-(2-hydroxyethyl)amine, N-phenyl-N-(2-hydroxypropyl)amine, N-acetyl-N-(2-hydroxyethyl)amine, N-acetyl-N-(2-hydroxypropyl)amine, N-(2-hydroxyethyl)piperazine and N-(2-hydroxypropyl)piperazine); and (3) Alcanolamines having primary amino group/s such as N-(2-hydroxyethyl)amine, N-(2-hydroxypropyl)amine, N-(hydroxybutyl)amine, N-(1,3-dihydroxy-2-methyl-propyl-2)amine, N-(2,3-dihydroxypropyl)amine, N-(2,3-dihydroxypropyl-2)amine, N-(1-aminomethyl-2-hydroxyethyl)amine and N-(2-hydroxy-3-amiino-propyl)amine.

Suitable sequestering agents include, among others, organic water-soluble sequestering agents such as ethylenediaminetetraacetic acid, N-hydroxyethylethylenediamine N,N',N'-triacetic acid, diethylenetriaminepenta-acetic acid, triethylenetetramine-pentaacetic acid, nitrilotriacetic acid, N-hydroxyethyliminodiacetic acid, diethanolglycine, ethylenediamine-N,N'-diacetic acid, glycol ether diaminetetra-acetic acid, 1,3-diaminopropane-2-ol-tetra-acetic acid, tartaric acid, citric acid, gluconic acid, saccharic acid and their alkali-metallic salts, polyacrylate, metallic salts of ligninsulfonic acid, Schiff bases such as N,N'-disalicylideneethylene-diamine, 1,3-diketones such as trifluoroacetylacetone, thenoyltrifluoroacetone and pivaloyltrifluoroacetone, organic sequestering agents soluble in solvents for coloring matter such as higher amido-derivatives of ethylenediamine-tetra-acetic acid, polymerphosphates such as sodium tripolyphosphate, sodium polymetaphosphate, sodium pyrophosphate and dihydrogen-sodium pyrophosphate.

Further in accordance with the present invention, a covering layer 16 is formed on the heat-sensitive developing layer 14. The covering layer includes a pigment prepared by coating the surface of natural mica with at least one of titanium oxide and iron oxide.

Generally, as incident light rays get into a laminate of a transparent thin film a phenomenon called multiple reflection takes place, resulting in an interference of light due to the optical thickness (product of geometrical thickness by reflective index) of transparent film material. When a thin layer of titanium oxide or iron oxide is formed on the surface of natural mica, part of the incident ray (for example, the green component) is reflected, while the complementary color (for instance the, red component) is transmitted. These are called the reflected color and the transmitted color respectively.

Hence, the tone of the heat-sensitive recording paper 10 appears to vary depending on the color of the covering layer. For instance, when the background is white, the normally transmitted color, is also reflected and both reflected and transmitted colors are visible. Meanwhile, when the background is black, the transmitted color is absorbed and the reflected color only is visible. Thus, with this heat-sensitive recording paper 10, colors hitherto unattainable can be obtained depending on the color of the covering layer 16.

FIG. 3 is a schematic chart of a process for coating the surface of natural mica with a least one of titanium oxide and iron oxide.

As shown in FIG. 3, nautral white mica 30 is subjected to wet grinding 32 and classification 34 to obtain a microthin mica leaf slurry 36 containing mica having a maximum particle size of 140μ. Mica slurry 36 is coated, for example, with titanium oxide or iron oxide by heat hydrolysis 38 followed by water washing and dewatering 40. The coated and washed natural mica is subjected to crystallization by drying and oxide roasting 42, whereby a natural mica having its surface coated with, for example, titanium oxide or iron oxide is obtained for use in the covering layer of the heat-sensitive recording paper of the present invention.

EXAMPLE 1

7 weight parts of a black (developing) leuco dye produced by Shin-Nisso Kako Co., Product No. PSD-T121, 10 weight parts of clay and 3 weight parts of a amide stearate powder were mixed in 100 weight parts of 5% aqueous solution of polyvinyl alcohol as an aqueous binder and an A-solution was prepared by dispensing this mixture for 5 hours in a centrifugal ball mill. Then, 7 weight parts of bisphenol A, 10 weight parts of clay and 3 weight parts of amide stearate were mixed in 100 weight parts of 5% aqueous solution of a polyvinyl alcohol as an aqueous binder and a B-solution was prepared by dispersing this mixture for 5 hours in a centrifugal ball mill. The A-solution and the B-solution were then mixed by stirring at a ratio of 1:3 and a uniformly dispersed paint was thus prepared. The resulting paint was applied to the surface of a quality paper at a rate of 64 g/m$^2$ by the use of a Mayer bar, the coated paper was dried under an air current for 3 minutes and a heat-sensitive paper was obtained.

On the other hand, 5 weight parts of Merck Japan's U Iriodine 200 was added to 100 weight parts of a 5% solution of polyvinyl alcohol and the mixture was stirred for 30 minutes in a homomixer to obtain a paint for forming a covering layer. This paint was applied on the aforementioned heat-sensitive paper to a dry coating weight of 5 g/m$^2$ and a heat-sensitive recording paper of this invention was thus obtained.

This heat-sensitive recording paper was developed for 1 second at 130° C. and under a pressure of 2 kg/m$^2$ by the use of Toyo Seiki Seisakusho's thermal inclination tester, a Heat Gradient tester produced by Toyo Seiki Seisakusho C. The Heat Gradient tester is a measuring apparatus constructed with five small heat plates providing a difference in temperature, i.e. a heat gradient. The developed parts showed a hitherto-unattainable gold-like color, while the undeveloped part was seen having to a pearl lustre.

EXAMPLE 2

A heat-sensitive recording paper was obtained in the same way as in Example 1 except that Merck Japan's Iriodine 100 was used for preparation of the paint for the covering layer. With this heat-sensitive recording paper the developed part showed a silver color, while the undeveloped part was seen to have a pearl lustre.

EXAMPLE 3

A heat-sensitive recording paper was obtained in the same way as in Example 1 except that Merck Japan's Iriodine 219 was used for preparation of the paint for the covering layer. With this heat-sensitive recording paper the developed part showed a violet color, while the undeveloped part was seen again to have a pearly lustre.

Figure 2:
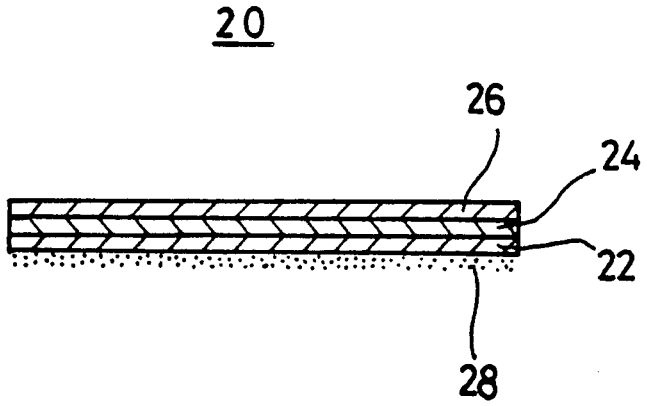
FIG. 2 is a sectional view illustrating a second embodiment of this invention.

FIG. 2 is a section view of a second embodiment of this invention.

This Hest-Sensitive Recording Paper is a Heat-Sensitive Recording label 20. The Heat-Sensitive Recording label 20 includes a sheet substrate 22 which is formed of a sheet material such as paper, or synthetic resin.

On one principal surface of the sheet substrate 22 there is formed a heat-sensitive developing layer 24 which is developed on heating and is the same as layer 14 in the first embodiment.

A covering layer 26 is formed on the heat-sensitive developing layer 24. The covering layer 26 includes a pigment prepared by coating the surface of natural mica with at least one of titanium oxide and iron oxide.

On the other surface of the sheet substrate 22 there is formed an adhesive layer 28. Suitable material for the adhesive layer 28 includes , for example a pressure sensitive adhesive such as acrylic rubber or synthetic rubber. Furthermore, sheet substrate 22 is temporarily stuck by adhesive layer 28 onto a long strip of paper coated with silicon resin on its surface. The long strip paper, that is say, a release paper is formed by coating the silicon resin on the surface of the paper. Heat-sensitive Recording label 20 is temporarily stuck onto the above-mentioned long strip paper by the adhesive power of the adhesive layer 28 and the label 20 is removed prior to use.

By virtue of this Heat-Sensitive Recording label, Heat-Sensitive material can be coated on the entire surface of sheet substrate 22, and it is not necessary to use Heat-Sensitive material in ink form and separately coat Heat-Sensitive Material. Therefore, the Heat-Sensitive label can be manufactured at low cost as compared with the prior art.

The heat sensitive recording paper of the present invention is able to develop in a color hitherto unattainable and adapt to the pattern of a wrapping paper when stuck thereto.

What is claimed is:

1. A heat-sensitive recording paper comprising, a sheet substrate having a first surface and a second surface;

a heat-sensitive developing layer formed on the first surface of said sheet substrate, said heat-sensitive developing layer comprising a color former, a color developer and a first binder for developing when heated; and a covering layer formed on said heat-sensitive developing layer comprising a pigment and a second binder, said pigment comprising natural mica coated with at least one component selected from the group consisting of titanium oxide and iron oxide.

2. A paper according to claim 1, wherein said natural mica has a maximum particle size of 140μ.

3. A paper according to claim 1, further comprising an adhesive layer formed on the second surface of said sheet substrate.

4. A paper according to claim 1, wherein said first binder comprises polyvinyl alcohol.

5. A paper according to claim 1, said heat-sensitive developing layer further comprising at least one filler selected from the group consisting of inorganic fillers and organic fillers.

6. A paper according to claim 1, said heat-sensitive developing layer further comprising a sensitizer.

7. A paper according to claim 1, said heat-sensitive developing layer further comprising a hardener for hardening said first binder.

8. A paper according to claim 1, said heat-sensitive developing layer further comprising a lubricant.

9. A paper according to claim 1, said heat-sensitive developing layer further comprising an organic oxidizing compound, and said color developer comprising a methine pigment.

10. A paper according to claim 9, said heat-sensitive developing layer further comprising a stabilizer for said methine pigment.

* * * * *